United States Patent [19]

Dillon

[11] Patent Number: 4,513,791

[45] Date of Patent: Apr. 30, 1985

[54] LENO SELVAGING AND STRETCH NOZZLE SYSTEM

[75] Inventor: Douglas M. Dillon, Asheboro, N.C.

[73] Assignee: Burlington Industries, Inc., Greensboro, N.C.

[21] Appl. No.: 462,977

[22] Filed: Feb. 1, 1983

[51] Int. Cl.[3] ..... D03D 47/34

[52] U.S. Cl. ..... 139/194; 139/429; 139/435

[58] Field of Search ..... 139/429, 435, 450, 451, 139/452, 194

[56] References Cited

U.S. PATENT DOCUMENTS

| | | | |
|---|---|---|---|
| 3,658,098 | 4/1972 | Mullekom | 139/194 |
| 3,678,965 | 2/1972 | Yamada . | |
| 4,084,623 | 4/1978 | Tojo et al. . | |
| 4,103,174 | 7/1978 | McClatchie et al. . | |
| 4,128,114 | 12/1978 | Tanaka . | |
| 4,185,667 | 1/1980 | Kendrick . | |
| 4,230,158 | 10/1980 | Hintsch . | |
| 4,404,996 | 9/1983 | Manders | 139/194 |

OTHER PUBLICATIONS

Ruti-L 5000 Operator's Manual, pp. L 0.55-e, L 4.1-e, and L 4.34.

*Primary Examiner*—Henry S. Jaudon

*Attorney, Agent, or Firm*—Cushman, Darby & Cushman

[57] ABSTRACT

A leno selvage and stretch nozzle system for an air jet loom utilizing a Venturi device receptive of pressurized air from the air jet system to provide vacuum at a tensioning nozzle mounted on the loom reed. The Venturi device exhausts into a second Venturi device, which receives the leno selvage to direct the leno selvage into a waste container.

5 Claims, 5 Drawing Figures

LENO SELVAGING AND STRETCH NOZZLE SYSTEM

BACKGROUND OF THE INVENTION

Field of the Invention

The present invention relates to leno selvaging and stretch nozzle systems, and in particular, to leno selvaging and stretch nozzle systems for use with air jet textile looms.

Selvage systems are utilized with looms to hold the loose ends of filling yarns extending outwardly from the edges of the woven fabric and to facilitate removal of the waste fringe of yarn at the edges of the fabric. Typical leno selvage systems, such as in a Ruti L5000 air jet loom, utilize what is known as a false selvage system. In general, a plurality of warp yarns are disposed in parallel, extending through a comb-like reed mechanism reciprocally mounted on the lay of the loom. The warp yarns are held either in relatively high or relatively low elevational positions to establish a space, referred to as a shed, just downstream of the reed. A filling yarn is directed through the shed between the respective sets of upper and lower warp yarns, and is "beaten up" against the already woven yarns by the reciprocating reed. The elevational positions of the individual warp yarns are reversed at predetermined intervals to weave the filling yarns and warp yarns into a fabric. Loom temples are provided at the edges of the fabric to keep the fabric from bunching during the beating process. At the outer edges of the warp yarns, (the edges of the fabric) respective inner sets of leno yarns are provided, which prevent unraveling of the fabric edges. However, in order to facilitate the cutting of the fringe of filling yarns extending beyond the edge of the inner leno yarns, a second (outer) set of leno yarns are provided, spaced apart from the inner set of leno yarns. The space between the inner and outer leno yarns is typically referred to as a skip dent. The outer leno yarns are woven with and bind the filling yarns, and are utilized to carry away the fringe waste. A cutting mechanism is disposed in the skip dent area to trim the fringe at the edge of the fabric to an acceptable length.

It is necessary to keep the filling yarn taut during the beating process. In conventional air jet looms such as the Ruti L5000, such tensioning is achieved utilizing a stretch nozzle disposed on the end of the reed, and a wide-mouthed suction nozzle fixed on the loom proximate to the end of the reed. Specifically, the stretch nozzle is disposed on the lay outside of the outer leno yarn. A sequenced pulsating jet of air is applied to one side of the nozzle, and suction applied at the other to draw a portion of the filling yarn upwardly into the nozzle, in a direction transverse to the filling yarn. Thus, tension is provided to pull the yarn taut. The end of the filling yarn is received and held in the wide-mouthed nozzle by suction. Separate air pressure and vacuum sources are utilized. It should be appreciated that the vacuum systems utilize substantial amounts of energy during continued operation of the loom, and tend to require frequent maintenance and filter replacement.

A minimum necessary length of the fringe waste is maintaining tension on the filling yarn. Typically, the fringe waste is shorter on the left side of the loom and longer on the right side, in order to accommodate the tensioning mechanisms. As a matter of economy it is desirable to minimize the length of the fringe waste. It is also desirable to remove any lint or the like from the filling yarn prior to beating by the reed.

SUMMARY OF THE INVENTION

The present invention provides a tensioning and leno selvaging system for an air jet loom, which eliminates the necessity of a separate vacuum source, and permits reduction of the length of the fringe waste.

More specifically, a Venturi device is operatively coupled into the air supply system associated with the main jet. The Venturi device provides a suction at a first output port thereof and exhausts the pressurized air at a second output port. The first output port is coupled to a suction nozzle mounted to move with the reciprocating reed. The nozzle receives each filling yarn in sequence, and maintains tension on the yarn while it is being beaten up the by reed. At the same time, the suction nozzle picks up any lint that has blown from the reed tunnel. The exhaust air from the Venturi device is utilized to facilitate disposal of the left and right fringe wastes. In this regard, left and right fringe wastes are directed through a conduit into a receptacle. The exhaust air from the Venturi device creates a suction in the conduit by a secondary Venturi effect to pull the fringe wastes through the conduit and into the receptacle.

BRIEF DESCRIPTION OF THE DRAWING

A preferred exemplary embodiment of the present invention will hereinafter be described in conjunction with the appended drawing, wherein like numerals denote like elements and.

DETAILED DESCRIPTION OF A PREFERRED EXEMPLARY EMBODIMENT

Figure 1:
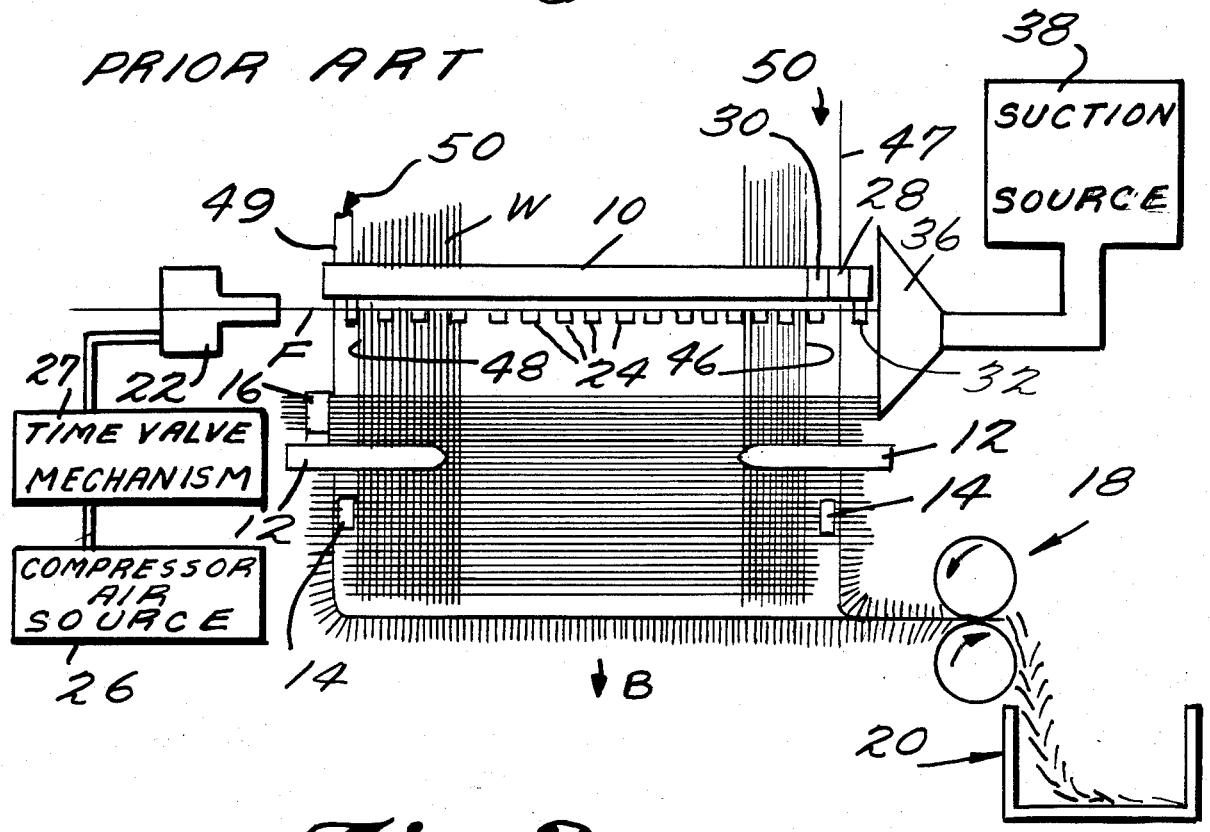
FIG. 1 is a schematic top view of a prior art Ruti L5000 air jet loom auxiliary selvage system, and associated components.
Figure 2:
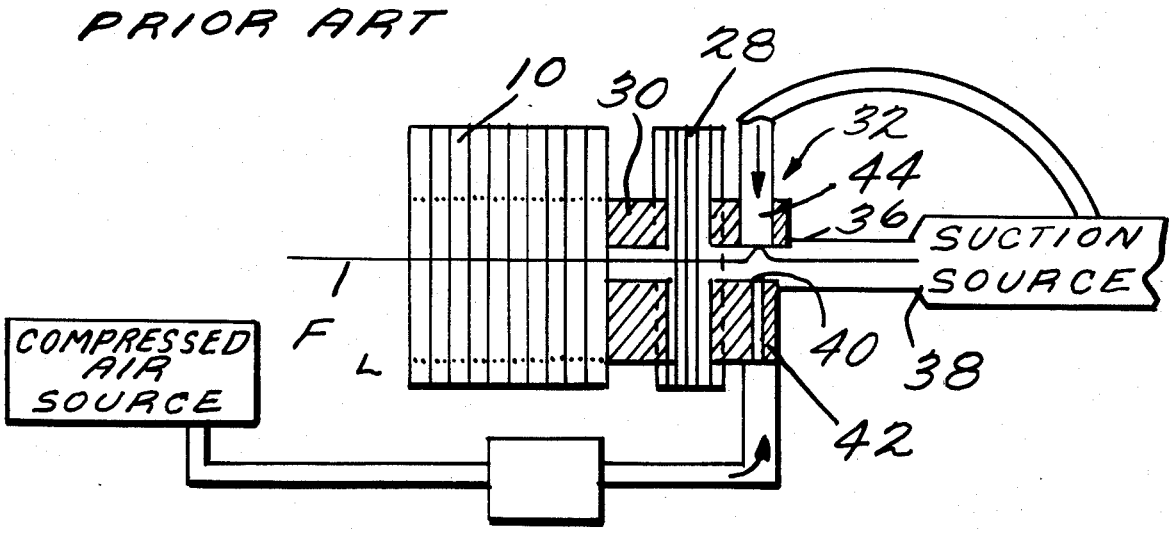
FIG. 2, is a schematic frontal view of the right-hand end of the reed, and associated selvage components, of the prior art apparatus of FIG. 1.

Referring to FIGS. 1 and 2, a prior art Ruti L5000 air jet loom is schematically shown. The air jet loom typically includes a frame (not shown), a reciprocating loom lay (not shown), a reed 10, respective temples 12, respective cutting mechanisms 14, a spring clamp 16, a set of leno draw-off wheels, and a waste receptacle 20.

Reed 10 is mounted on the reciprocating loom lay (not shown). Referring briefly to FIG. 2, reed 10 comprises a plurality of individual metal elements, which are spaced apart at predetermined distances. The spaces between adjacent elements are often referred to as dents. The respective warp yarns, disposed in a direction generally perpendicular to the reed (parallel to the direction of reciprocating movement), are drawn through the dents, to maintain spacing therebetween. A short reed section 28, is disposed a predetermined distance from the right end of reed 10. Reed section 28 is suitably coupled to the right end of reed 11 by a conventional Ruti attachment bracket (not shown), and reciprocates with reed 10. A conventional filling yarn detector 30 is disposed between reed 10 and short reed section 28. A conventional stretch nozzle 32, (to be hereinafter more fully described) is disposed adjacent to the right side of short reed section 28. As will be explained, stretch nozzle 32 cooperates with a stationary wide mouthed suction nozzle 36 (FIG. 1), and a suction source 38, to provide proper tension in the filling yarns during the beating process.

Referring again to FIG. 1, respective inner leno yarns 46 and 48 (usually each 3 yarns) are provided at the right and left sides of the weft yarns. The inner leno yarns 46 and 48 weave (e.g. alternate elevational positions after each filling yarn) at the edge of the fabric to prevent unraveling of the fabric edges. Respective right and left outer leno yarns 47 and 49 are disposed spaced apart from the right and left outer leno yarns 46 and 48. Outer leno yarns 47 and 49 are utilized to bind the fringe of filling yarns extending beyond the edge of the fabric. The individual yarns of the outer leno yarns 47 are spaced by short reed section 28. A similar short reed section (not shown) is provided spaced apart from the main reed at the far left side of reed 10 for use in conjunction with outer leno yarns 49. The spaces 50 between right inner leno yarns 46 and outer leno yarns 47 and left inner leno yarns 48 and outer leno yarns 49 are typically referred to as skip dents.

Referring again to FIG. 2, stretch nozzle 32 includes a central passage 40, disposed to receive filling yarn F, a relatively small diameter lower conduit 42 and a relatively large diameter upper conduit 44. Lower conduit 42 is coupled, by flexible tubing, through timing valve mechanism 27 to compressed air source 26. Upper conduit 44, communicates through a flexible tube (not shown in FIG. 1) with suction source 38.

Stretch nozzle 32 and wide-mouthed suction nozzle 36 cooperate to provide proper tension in the filling yarn during the beating process. Filling yarn F is directed through central passage 40 of stretch nozzle 32 and is drawn into suction nozzle 36. Compressed air is selectively applied through lower conduit 42 to direct a loop of filling yarn F upward (in a direction transverse to the plane of reed movement) towards upper conduit 44. The suction in conduit 44 maintains the loop and thus tensions the filling yarn. Suction nozzle 36 prevents filling yarn F from being completely drawn into upper conduit 32.

Referring again to FIG. 1, each filling yarn in turn, is directed by main jet 22 and relay nozzles 24 through the warp yarn shed so that it is disposed generally parallel to reed 10. Stretch nozzle 32 and suction nozzle 36 cooperate to maintain proper tension in the filling yarn. Reed 10 then moves downstream, beating the filling yarn against the already woven fabric. Stretch nozzle 32 reciprocates with the reed, and stationary nozzle 36 is wide enough to accommodate the breadth of the reed reciprocation so that the tensioning is maintained in the filling yarn throughout the beating process. As the filling yarn is beat against the already woven fabric, spring clamp 16, mounted on the temple stand on the left-hand side of the fabric, receives and holds the filling yarn. The right-hand end of the filling yarns is maintained in suction nozzle 36. The elevational positions of the warp yarns and leno yarns are altered and reed 10 reciprocates to upstream of the shed to accommodate the next filling yarn. The resulting weave with the leno yarns maintains the beaten filling yarn in position and provides tensioning when reed 10 returns to the upstream position.

Cutting mechanisms 14 are disposed downstream of temples 12 in the right and left skip dent areas 50. Cutting mechanisms 14 cut off the fringe of filling yarns extending beyond the edge of the fabric as defined by the inner leno yarn 46 and 48. The cut fringe of filling yarn is bound to the outer leno yarns 47 and 49. Outer leno yarns 47 and 49 are directed to draw-off wheels 18, which pull the leno yarns, and thus the fringe, into waste receptacle 20.

It should be appreciated that the fringe waste on the right-hand side must be of sufficient length to accommodate operation of stretch nozzle 32 and suction nozzle 36. The right side fringe waste is typically on the order of 2.5 inches in length. Over extended operation of the loom, the fringe waste becomes an item of considerable cost. In addition, the conventional system utilizes separate compressed air and suction sources. Suction source 38 not only consumes a considerable amount of energy during operation of the loom, but also tends to require continual maintenance.

The present invention provides a leno selvaging and stretch nozzle system which eliminates separate suction source 38, and draw-off wheels 18, while at the same time decreasing the minimum length of the waste fringe on the right side of the fabric from on the order of 2.5 inches, to on the order of 1.0 inch in length. Over long term operation of the machine, such decrease in fringe waste and reduced energy consumption and maintenance provides substantial cost savings.

Figure 3:
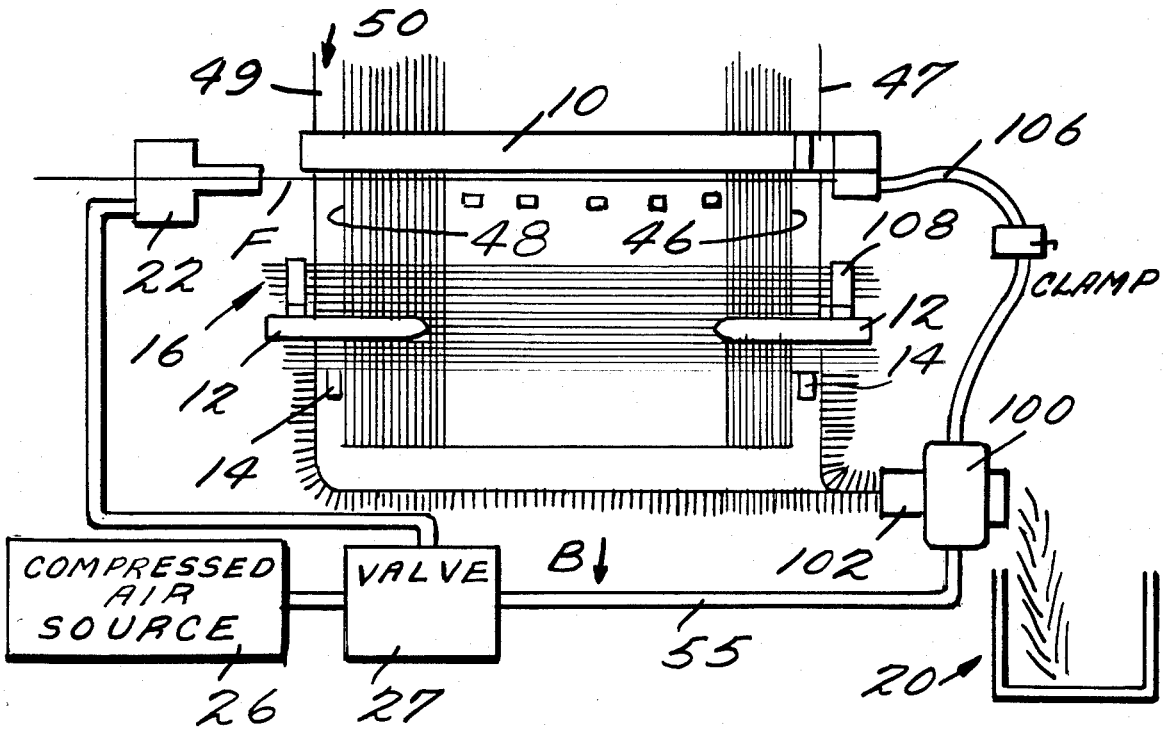
FIG. 3, is a top schematic view of an air jet loom in accordance with the present invention.
Figure 4:
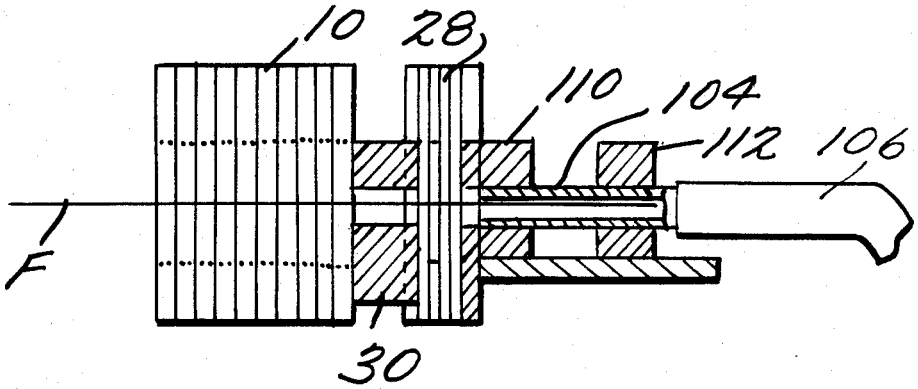
FIG. 4, is a side view of the reed tunnel nozzle of the present invention.
Figure 5:
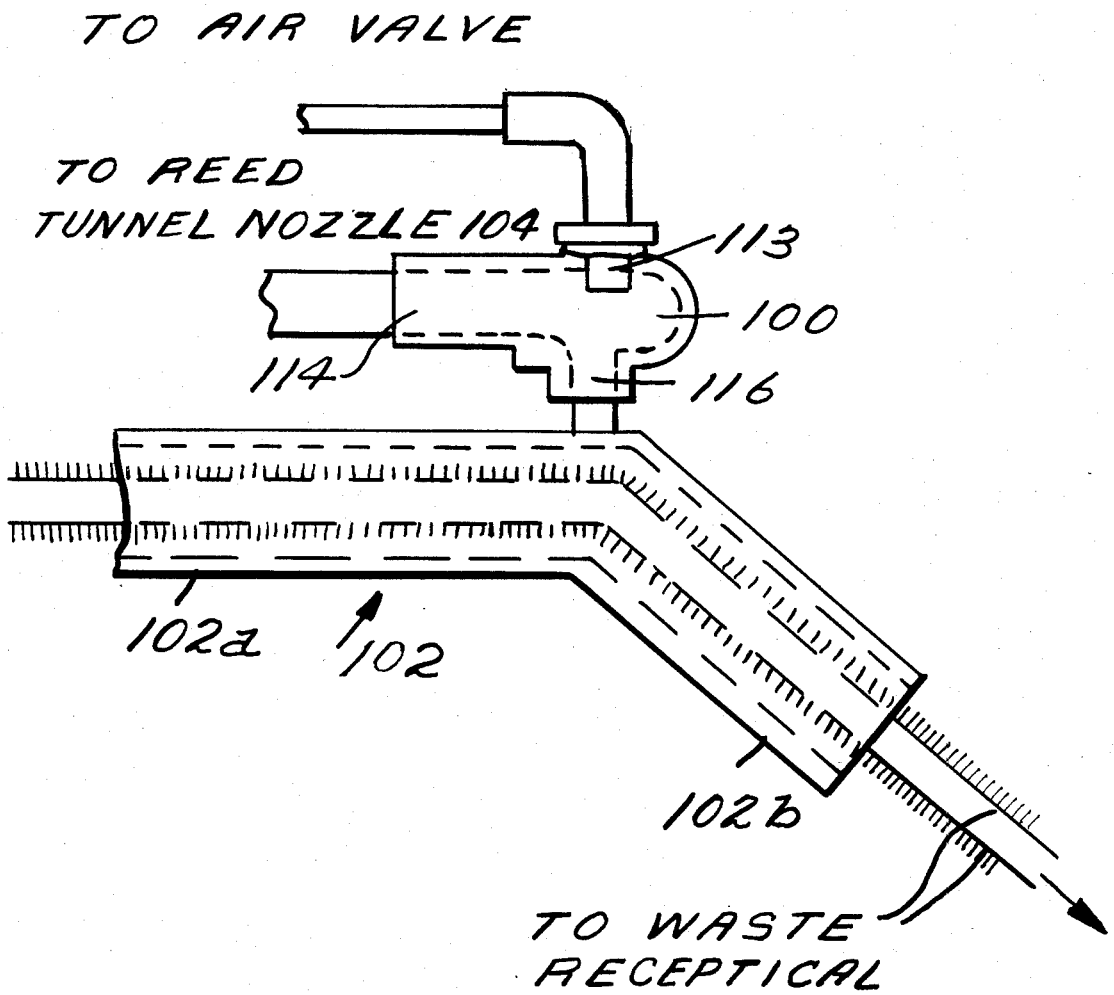
FIG. 5, is a side view of a Venturi device and fringe waste removal conduit in accordance with the present invention.

Referring now to FIGS. 3, 4 and 5, a leno selvaging and stretch nozzle system in accordance with the present invention will be described. Suction source 38, suction nozzle 36, stretch nozzle 32 and draw-off wheels 18 of the conventional system shown in FIGS. 1 and 2 are eliminated, and replaced by a two output port Venturi device 100 and a cooperating routing conduit 102, a suction nozzle 104, a flexible tube 106, and an additional spring clamp 108.

Referring briefly to FIG. 4, suction nozzle 104 suitably comprises a 3 inch lengh of $\frac{1}{4}$ inch copper tubing mounted to the reciprocating lay by plastic blocks 110 and 112. Nozzle 104 is disposed to receive the filling yarns after the yarns are directed through the warp yarn shed. As shown in FIG. 3, suction nozzle 104 communicates with Venturi device 100 through flexible tubing 106. Suction developed by the Venturi device draws the filling yarn into nozzle 104, pulling the filling yarn in its original direction of travel, parallel to reed 10 and in the plane of reed movement, to maintain sufficient tension in the filling yarn during the beating process. At the same time, any lint from the filling yarn is pulled into nozzle 104 for disposal.

Venturi device 100 and conduit 102 cooperate to develop a suction using compressed air source 26, while at the same time tensioning outer leno yarns 47 and 49, and removing the fringe waste. Venturi device 100 is suitably a commercially available device, such as a Leesona 790993-2X "air-cleaner". With specific reference now to FIGS. 3 and 5, Venturi device 100 suitably includes an input port 113 and first and second output ports 114 and 116, respectively. A pulsed air flow from timing valve 27 (one pulse per pick, i.e. 500 pulses per minute, applied in the prior art apparatus of FIG. 2 to stretch nozzle lower conduit 42) is applied to input port 113 and directed outwardly to second output port 116, causing, by the Venturi effect, a suction to be established at a first output port 114. Conduit 55 connects valve and Venturi 100.

Second (exhaust) output port 116 communicates with routing conduit 102. Conduit 102 is suitably formed of two lengths 102*a*, 102*b* ($8\frac{1}{2}$ inches, and $9\frac{1}{2}$ inches) of 1 9/16 inch diameter plastic tube, coupled together by a 45 degree plastic elbow. Exhaust output port 116 of Venturi device 100 is disposed in the elbow of conduit 102, such that the exhaust of Venturi device 100 is directed through the rear length 102*b* of conduit 102, creating, through a secondary Venturi effect, a suction in the front length 102*a* of conduit 102. The right and left leno yarns, and fringe are introduced into the front length 102*a* of conduit 102 and are pulled by the Venturi effect suction through conduit 102 into waste receptacle 20. The outer leno yarns 47 and 49 are thus tensioned and fringe waste disposed of.

Referring again to FIG. 3, as in the conventional air jet loom, each filling yarn in turn is directed by main jet 22 and relay nozzles 24 through the shed so that it is disposed generally parallel to reed 10. The right end of the filling yarn is received by suction nozzle 104 and tension is provided. Timing valve mechanism 27 provides air to Venturi device 100 so that a vacuum is created and communicated through flexible tube 106 to nozzle 104 to maintain tension in the filling yarn. Reed 10 then moves downstream, beating the filling yarn against the already woven fabric. Suction nozzle 104 reciprocates with the reed so that tension is maintained on the filling yarn throughout the beating process. At the end of the reed stroke the filling yarn is received by spring clamps 16 and 108. The elevational positions of the warp and leno yarns are altered, and the resulting weave maintains the beaten filling yarn in position. Timing valve 27 at this point momentarily cuts off the air to Venturi 100 relieving the suction at nozzle 104 during the return strokes of the reed, facilitating withdrawal of the end off the filling yarn from suction nozzle 104. Tension in the filling yarns is thereafter maintained by clamps 16 and 108 and leno yarns.

Cutters 14 trim the excess fringe from the fabric, which fringe is bound to outer leno yarns 47 and 49. Leno yarns 47 and 49 are disposed through conduit 102 and into waste receptacle 20. The exhaust air from Venturi device second output port 116 pulls the selvage waste through the conduit 102 and into the waste receptacle. It should be noted that while the output of port 116 is pulsating in nature, the air pulses recur at a sufficiently high rate (e.g. 500 pulses per minute) that an apparently constant pressure is exerted on the selvage waste.

It will be appreciated that the present invention provides a particularly advantageous leno selvaging and stretch nozzle system. A number of high energy consumption and high maintenance items are eliminated, while at the same time providing significant savings in reduced selvage waste. A conventional air jet loom can easily be modified in accordance with the present invention and sources of air pressures higher than the pressures used in conventional systems are not required.

It will be understood that the above description is of a preferred exemplary embodiment of the present invention and that the invention is not limited to the specific form shown. Modifications may be made in the design and arrangement of the elements without departing from the spirit of the invention as expressed in the appended claims.

I claim:

1. In an air jet loom for weaving fabric from warp yarns and filling yarns, said loom comprising:

a reed disposed transversely of said warp yarns;

air jet means, including at least one pressurized air source, for effecting predetermined relative dispositions of said filling yarns to said warp yarns and reed, said filling yarns extending beyond said warp yarns and weaving with leno yarns to form respective fringes on the sides of said fabric;

tensioning means for providing tension in said filling yarns and comprising: a Venturi device, responsive to pressurized air from said air jet means pressurized air source and having at least first and second output ports, for generating a suction at said first output port and exhausting pressurized air at said second output port; and a suction nozzle, communicating with said Venturi device first output port and coupled for movement with said reed, disposed for receiving said filling yarns whereby a tension is generated in said filling yarns; and trimming means, for removing said fringes and disposed of the removed fringes, said trimming means including suction generating means, communicating with said Venturi device second port, and disposed to receive said removed fringes, for generating a suction from said exhaust pressurized air, which suction operates upon said removed fringes.

2. In the loom of claim 1, wherein said trimming means suction generating means comprises:

a conduit, having first and second transversely disposed legs, said first conduit leg being disposed to receive said fringes; and means for establishing communication between said Venturi device second port and the juncture between said first and second conduit legs such that said exhaust pressurized air is directed through said second conduit leg and creates a suction in said first conduit leg to pull said fringes through said conduit.

3. An air jet loom for weaving fabric from warp yarns and filling yarns, comprising:

a reciprocable reed;

a pressurized air source;

a main jet cooperating with said air source, disposed on one side of said reed;

a Venturi device, including an input port communicating with air source, and first and second output ports, air from said air source being exhausted through said second output port and creating a suction at said first output port;

a nozzle, mounted for reciprocation with said reed, disposed on the opposite side of said reed from said main jet to receive said filling yarns after said yarns transverse said reed;

flexible tubing for establishing communication between said Venturi device first output port and said nozzle, to create a suction in said nozzle to draw on said filling yarns;

selvage means for trimming said fabric, said selvage means forming at least one leno bound fringe;

a conduit, including first and second legs, relatively disposed at a predetermined angle;

said conduit first leg being disposed to receive said leno bound fringe; and means for establishing communication between said conduit and said Venturi device second output port, to exhaust said pressurized air through said conduit second leg and create a suction to draw said leno bound fringe through said conduit.

4. A method of reducing leno selvage in weaving warp and filling yarns into a fabric using an air jet loom of the type having a reciprocating reed, with a main jet disposed on one side of the reed, said method comprising the steps of:

disposing a suction nozzle for reciprocation with the loom reed to receive filling yarns and draw on said filling yarns in a direction generally parallel to said reed, so that the length of fringe necessary for establishing tension in said filling yarn is reduced;

generating a suction in said nozzle by applying pressurized air to a venturo device to generate a suction at a first output port thereof; and communicating said suction to said nozzle;

disposing a conduit to receive leno selvage; and applying the exhaust of said venturi device to create a suction in said conduit for removal of the leno selvage.

5. The method of claim 4 wherein said communicating step comprises the step of coupling said nozzle to said Venturi device first output port through a flexible tube.

* * * * *